United States Patent [19]

Balicki

[11] 3,933,015

[45] Jan. 20, 1976

[54] ARMORED CABLE-TYPE LOCK ASSEMBLY WITH SPECIAL MEANS FOR RENDERING IT TAMPER-PROOF

[76] Inventor: Stanley C. Balicki, 2834 North Commerce St., Franklin Park, Ill. 60131

[22] Filed: June 20, 1974

[21] Appl. No.: 481,062

[52] U.S. Cl. ..... 70/49; 70/13

[51] Int. Cl.[2] ..... E05B 67/06

[58] Field of Search ..... 70/49, 30, 18, 14, 15, 70/417; 174/102 R, 111; 24/2–4

[56] References Cited

UNITED STATES PATENTS

| | | | |
|---|---|---|---|
| 1,545,660 | 7/1925 | Johnson | 70/49 X |
| 2,190,661 | 2/1940 | Haver | 70/49 |
| 3,765,196 | 10/1973 | Balicki | 70/49 |

*Primary Examiner*—Robert L. Wolfe
*Attorney, Agent, or Firm*—Norman H. Gerlach

[57] ABSTRACT

An armored cable-type lock assembly embodying an armored cable consisting of a length of stranded steel cable on which there are threaded in bead-like fashion armor pieces in the form of alternately arranged ball members and socket members. A fixed terminal lock housing at the proximate end of the cable is provided with a transverse bore through which the distal end of the cable may be passed so that the housing functions as an overlap slip joint and causes the cable to form a closed retaining loop when the distal end of the cable is in the bore, the size of such loop being regulated by pulling or pushing the cable through the housing. A key-operated cylinder lock which is associated with the housing has a locking bolt which, when projected into its locked position, engages the opposed ends of a pair of adjacent socket members and forces them downwardly against the bottom wall of the bore, the latter being recessed in wide angle V-fashion so that the captured or bolt-engaged part of the armored cable develops a kink within the bore and is thus locked against endwise sliding through the bore. A fitting at the distal end of the armored cable is in the form of a thimble having a recessed inner end that mates with a half-ball which is integral with a special terminal armor piece. Both terminal arrangements are such that the possibility of hacksaw or abrasive attempts to penetrate the armor is inhibited.

4 Claims, 7 Drawing Figures

ARMORED CABLE-TYPE LOCK ASSEMBLY WITH SPECIAL MEANS FOR RENDERING IT TAMPER-PROOF

The present invention relates to an armored cable-type lock assembly of the general type which is shown and described in U.S. Pat. Nos. 3,696,647 and 3,765,196, granted to me on Oct. 10, 1972 and Oct. 16, 1973, respectively, the present assembly being designed as an improvement over those which are disclosed in such patents.

Lock assemblies of the general type under consideration are designed primarily for use as tie-down, theft-prevention instrumentalities for motorcycles, go-carts, snowmobiles, small pleasure boats and other vehicles and in this respect the present lock assembly does not differ from the armored cable-type lock assemblies of my aforementioned patents. Structurally, insofar as the present assembly is concerned, the armored cable is similar to that which is disclosed in each of such patents in that it consists of alternately arranged ball members and socket members which are threaded onto a flexible stranded cable. Functionally also there is a similarity between the patented and the present cable-type lock assemblies in that each includes a pair of end fittings, one of which is in the form of a proximate lock housing which establishes a slip joint for the distal end region of the armored cable and the other of which establishes a distal thimble-like, spring-biased, slack or lost-motion take-up device for the armor pieces of the cable. Furthermore, each lock assembly is capable of being put to use for tie-down purposes by threading the distal end region of the armored cable through a transverse bore in the lock housing in order to establish a variable size loop, and then locking such distal end region in a fixed position when the desired loop size has been attained, a key-operated cylinder lock which is secured within the lock housing being provided for this purpose. Because of the similarities between the present lock assembly and those of the aforementioned patents, the general objects of the present invention do not differ appreciably from those set forth in the patents. However, the specific improvements which are exhibited by the present invention reside mainly in a more effective tamper-proof means for anchoring the distal end region of the armored cable within the transverse bore of the lock housing so as to disable the slip joint, and also in a more effective way of establishing an articulated (bending) joint between the distal slack or lost-motion take-up device and the next adjacent armor piece of the cable, the latter joint also presenting tamper-proof characteristics. The term "tamper-proof" as used herein relates principally to the resistance which the present lock assembly offers to cutting through the armored cable in the vicinity of either terminal end member, i.e., the lock housing or the slack or lost-motion take-up device.

It is obvious that, given the necessary time and the proper abrasive or cutting tool such as a high-grade hacksaw or a power-actuated diamond-edge abrasive blade, any armored cable of the type under consideration may eventually be severed at any place or region therealong, providing, of course, that a clamping unit such as a vise can be applied to the part of the cable to be sawed or abraded. Where ball members are utilized as parts of the armored cable, it is difficult, if not impossible, to engage such members in a vise inasmuch as they are, in the main, encompassed in the adjacent sockets of the socket members and, therefore, largely concealed or covered and any attempt to engage them with a hacksaw will result merely in rotation of the balls back and forth with little or no abrasion or cutting taking place. To clamp one of the socket members in a vise and apply a hacksaw thereto would consume an inordinate amount of time, more time in fact than is allotted to a contemplative thief who must perform his operations in a hurry and who is dealing with case-hardened steel armor.

The "Achilles heel" or point of weakness of an armored cable-type lock assembly of the type under consideration is twofold. In the first place, if the bore in the lock housing at the proximate end of the armored cable has therein a truly cylindrical or straight bore for slidably receiving the distal end region of the armored cable as illustrated in my two aforementioned patents, the only part of the lock assembly as a whole which precludes disabling of the slip joint, i.e., slippage of the housing-encased end region of the cable away from the housing, is the lock bolt when the cylinder lock of the assembly is in its locked position. In view of the fact that such bolt is not of major proportions or dimensions and, hence, has a certain amount of fragility, it may be readily broken or fractured in the event excessive force is applied to the armored cable in an attempt to break the aforementioned slip joint. The other point of weakness is that if the lost-motion take-up device or fitting at the distal end of the armored cable is swung sharply at an angle with respect to the adjacent armor piece of the cable, the adjacent ball member will become sufficiently displaced with respect to the oppositely disposed socket in the adjacent socket member as to expose the adjacent portion of the stranded cable and thus permit cutting thereof with a hacksaw or other abrasive tool. In the event that the cable is cut or sawed at such point, the assembly as a whole becomes ineffective, even though the lock is in its locked position, by reason of the fact that all of the armor pieces may be slid off of or stripped from the cable thus rendering the assembly useless for its intended purpose.

The present invention is designed to overcome the above-noted limitations that are attendant upon the construction and use of either of my patented armor cable-type lock assemblies or similar lock and, toward this end, the invention contemplates the provision of an armored cable-type lock assembly which closely resembles those of my aforementioned patents, but in which the transverse bore which is provided in the lock housing, instead of being truly cylindrical or linearly straight throughout, is formed with a bottom region which is recessed in V-fashion and at a wide angle on the order of 170° so that when the distal end region of the armored cable is threaded through the bore for loop-forming purposes as previously described and one of the ball members is brought into alignment with the bottom of the V, the locking bolt which is associated with the cylinder lock within the lock housing may be projected downwardly so as to engage the opposed rim regions of the two adjacent ball-encompassing socket members and force them downwardly against the recessed bottom of the transverse bore thus bending that portion of the armored cable that is within the bore and establishing a "kink" which cannot shift in either direction, and thereby securely locking the housing-surrounded end region of the armored cable within the transverse bore against axial shifting. The locking bolt is key-operated and when it is withdrawn upwardly, the kink in the cable is released so that the armored cable may again be slid in either direction through the bore. When the armored cable is thus locked within the bore, the ball member which is disposed opposite to the bolt of the lock is entirely concealed within the housing, the adjacent socket members are both firmly wedged against the bottom wall of the bore and no angular movement thereof is possible so that if the lock is to be defeated by a sawing operation, many hours of sawing time would be consumed, merely to saw through the socket member, only to reach an internal ball member which is not susceptible to sawing since it is rotatable and cannot be held stationary for sawing purposes. The aforementioned V-formation of the bottom portion of the bore in the housing materially augments the locking or holding action of the bolt and thus gives tamper-proof characteristics to the present lock assembly.

In the case of the distal thimble-like slack or lost-motion take-up device at the distal end of the cable of the present lock assembly, sawing through the armored cable is greatly hampered by the provision of an adjacent terminal armor piece which, instead of being in the form of a ball, is in the form of a half-ball which is made as an integral part of the adjacent socket member to the end that such particular socket member has a half-ball at one end and a socket at its other end. With such an armor piece adjacent to the slack or lost-motion device at the distal end of the armored cable, if such device is swung sharply with respect to the adjacent armor piece of the cable, there is no space leading to the adjacent portion of the stranded cable due to the half-ball being formed integrally with the adjacent socket member and, hence, sawing of such portion of the cable is effectively prevented or eliminated.

The provision of an armored cable-type lock assembly such as has briefly been outlined above constitutes the principal object of the present invention.

Another object of the invention is to provide an armored cable-type lock assembly which is generally of new and improved construction and is characterized by high efficiency, simplicity of operation, low cost of manufacture, and high resistance to tampering.

Numerous other objects and advantages of the invention, not at this time enumerated, will become readily apparent as the following description ensues.

The invention consists in the several novel features which are hereinafter described and are more particularly defined by the claims at the conclusion hereof.

In the accompanying two sheets of drawings forming a part of this specification, one illustrative form of the invention is shown.

Figure 1:
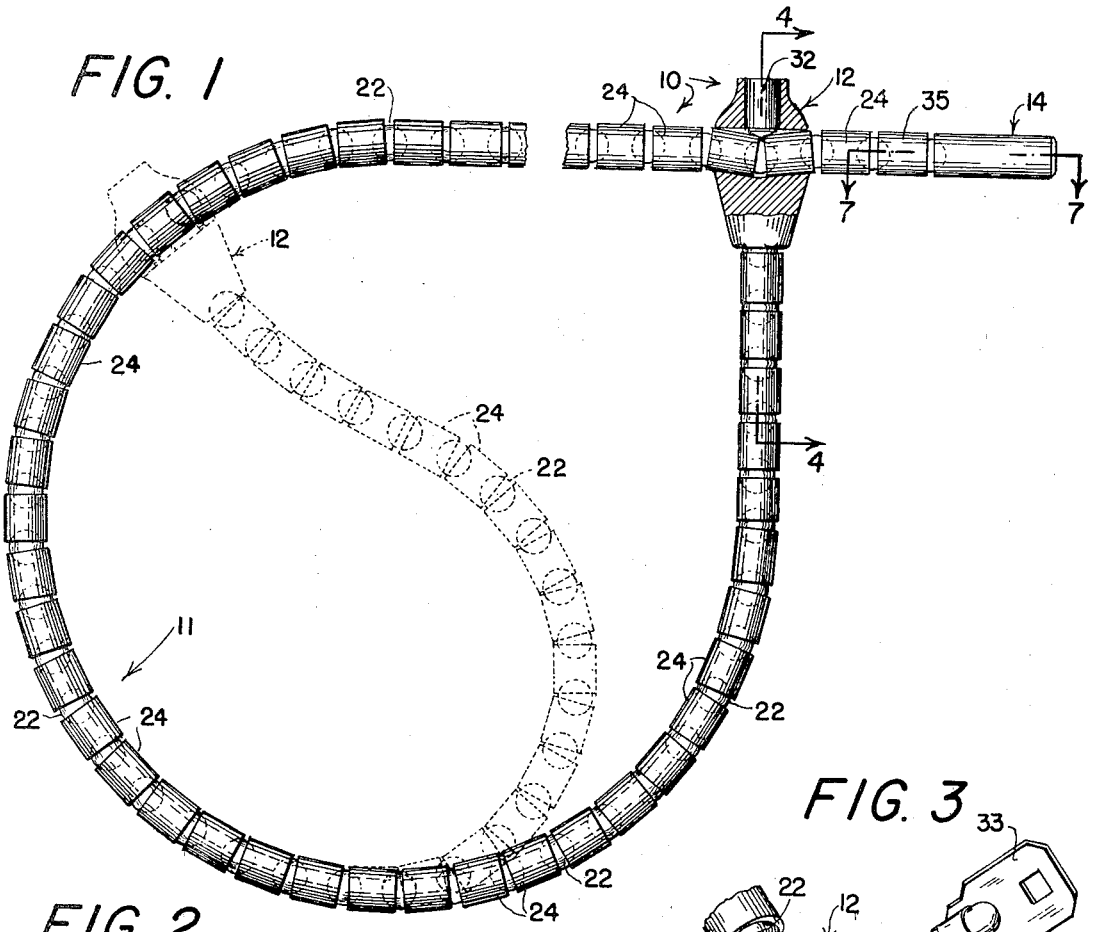
FIG. 1 is a side elevational view, partly in section, of an armored cable-type lock assembly embodying the present invention, the assembly being shown in its operative looped condition.
Figure 3:
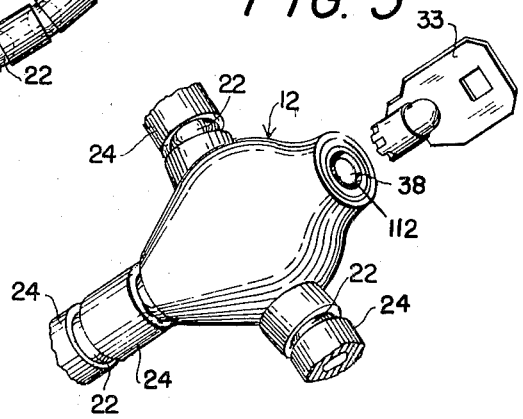
FIG. 3 is an enlarged fragmentary perspective view of one of the end fittings, namely, that which constitutes the housing of the key-actuated lock unit.
Figure 2:
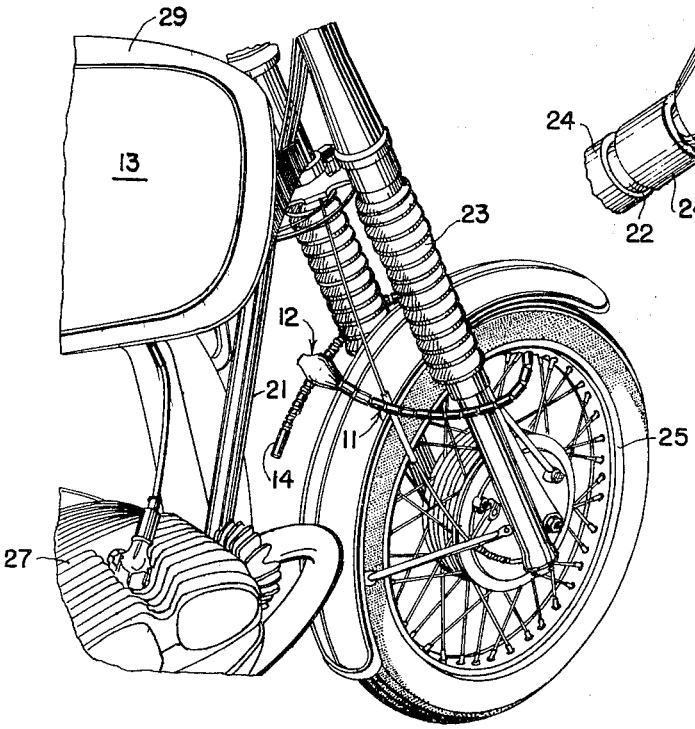
FIG. 2 is a fragmentary perspective view showing the improved lock assembly operatively applied to a motorcycle in order to prevent theft of the latter.

Referring now to the drawings in detail and in particular to FIGS. 1 and 2, the armored cable-type lock assembly of the present invention is designated in its entirety by the reference numeral 10 and it is shown as being operatively applied to a motorcycle which is fragmentarily shown in FIG. 2 and is designated by the reference numeral 13. Briefly, the lock assembly 10 is comprised of a length of armored cable 11, the details of which will be described presently, and on the end of which there are applied two fittings, one of the fittings being in the form of a slip joint which is established by the provision of a lock housing 12 and the other fitting being in the form of a terminal slack or lost-motion take-up device 14. For descriptive purposes herein, the end of the cable to which the device 14 is applied will be referred to as the "free" or distal end of the armored cable 11 and the end which has the lock assembly will be referred to as the proximate end of the cable.

The motorcycle 13 is illustrated as being of conventional design and embodies the usual factory equipment such as a frame 21, a steering fork assembly 23, wheels 25, an internal combustion engine assembly 27, and a combined saddle and gas tank component 29, only the forward section of the motorcycle 13 being fragmentarily shown. The armored cable-type lock assembly 10 may be applied to the motorcycle 13 in various ways for theft prevention purposes, as typical way being to pass the armored cable 11 through the rim of the front wheel 25 and between front wheel spokes and then around a portion of the steering fork assembly 23, after which the free end of the armored cable is threaded through a transverse bore 31 (see FIG. 4) in the lock housing 12 in order to produce or form a closed loop which subsequently is shrunk or drawn taut upon the motorcycle by pulling the free end of the armored cable through the bore 31 until the desired loop span is attained. As will be made clear subsequently, in order to pass the free end of the armored cable 11 through the lock housing 12, it is necessary to operate a cylinder lock 16 which is installed in the lock housing 12, utilizing a proper key 33 (see FIGS. 4 and 6) to unlock the cylinder lock. After the free end of the armored cable 11 has been pulled through the bore 31 to the desired extent, the lock housing 12 may be securely locked in the medial or proximate end region of the armored cable by again manipulating the cylinder lock 16 and withdrawing the key 33 therefrom, all in a manner that will be described presently.

Considering now the specific nature of the lock assembly 10, and referring particularly to FIGS. 1 and 4 to 7, inclusive, the armored cable 11 is comprised of a cable proper 20 in the form of a centrally disposed length of flexible stranded steel cable over which there is threaded a series of tubular sheathe-like armored pieces including alternately arranged male ball members 22 and female socket members 24. All of the ball members 22 are identical in configuration and are in the form of spherical beads of relatively massive or sturdy construction. Each ball member presents an outer spherical surface which is interrupted by a central bore 26 which extends diametrically through the member and receives the stranded steel cable 20. The opposite ends of the bore 26 in each ball member 22 communicate with frusto-conical recesses 28 which perform a function that will be set forth presently. The diameter of the bore 26 is slightly greater than the outside diameter of the stranded steel cable 20 with the result that the ball member 22 will slide easily along the cable 20 during cable and ball member assembly operations and with the further result that, after the assembly is complete, the ball members will not bind against the cable.

All of the socket members 24 are identical, but a special combined ball and socket member 35 (see FIGS. 1 and 7) is interposed between the terminal device 14 and the next adjacent socket member 24 and serves a function that will be described subsequently.

Each socket member 24 is provided with an axially or longitudinally extending bore 30 therethrough and at each end of the bore there is formed a frusto-conical recess 32, the outer rim of which communicates with a semi-spherical socket 34 of annular configuration, the curvature of the socket being conformable to the curvature of the outer surface of the adjacent ball member 22 in the alternate arrangement of ball and socket members 22 and 24. The effective depth of each socket 34 is slightly less than the radius of a ball member 22 and, consequently, an intervening ball member 22 between two adjacent socket member 24, when seated within the opposed sockets 34, will present a limited exposed peripheral portion of the ball member and will maintain the adjacent socket members slightly spaced apart and thus establish a flexible ball and socket joint between such adjacent members. It is to be noted at this point that the bores 26 in the ball members 22 and the bores 30 in the socket members 24 are of relatively short axial extent, specifically on the order of approximately twice the diameter of the bores. The slant angle of the frusto-conical recesses 28 at the ends of the bores in the ball members 22 and of the frusto-conical recesses 32 at the ends of the bores 30 in the socket members 24 is on the order of 30°, the various recesses constituting clearance areas which allow for relatively steep angular bends or curves in the assembled armored cable since there are no sharp rim edges that ordinarily would contact the stranded cable 20 in the absence of such clearance recesses. Whereas, in the absence of such clearance recesses, an angular flexion of approximately 45° would be possible, when the frusto-conical recesses 28 and 32 are provided a flexion of as much as 55° is made possible without the danger of cutting the cable.

It has been previously stated that the ball members 22 and the socket members 24 are alternately threaded upon the stranded steel cable 20, there being the same number of ball members as there are socket members so that the proximate end of the armored cable 11 will present a socket member 24 while the other end of the ball and socket portion of the armored cable will present a ball member 22. After the requisite number of ball and socket members have been threaded on the stranded steel cable 20 so as to cover such cable from end to end, each end of the cable will have applied thereto a tubular machined retaining collar, one such collar 40 being designed for application to the lock housing 12 and the other collar 42 being designed for application to the slack or lost-motion take-up device 14. However, before application of these collars to the stranded steel cable 20, certain other armored cable assembly adjuncts will be interposed between the lock housing and its adjacent socket member 24, and between the slack or lost-motion take-up device 24 and its adjacent ball member for purposes that will be made clear presently.

Figure 4:
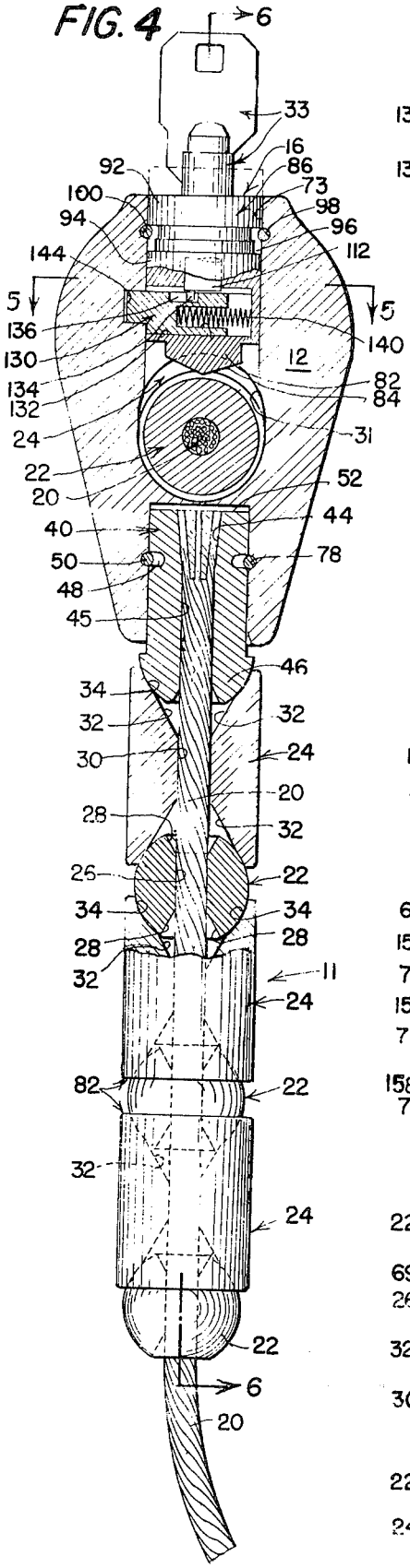
FIG. 4 is an enlarged fragmentary sectional view, partly in elevation, of the assembly taken substantially centrally and longitudinally through the interlocked end regions of the cable-type lock assembly, the view being taken on the line 4—4 of FIG. 1 and in the direction of the arrows.
Figure 5:
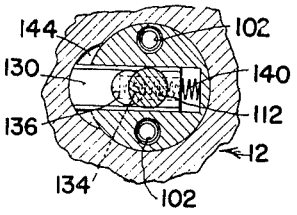
FIG. 5 is a transverse sectional view taken on the line 5—5 of FIG. 4.
Figure 6:
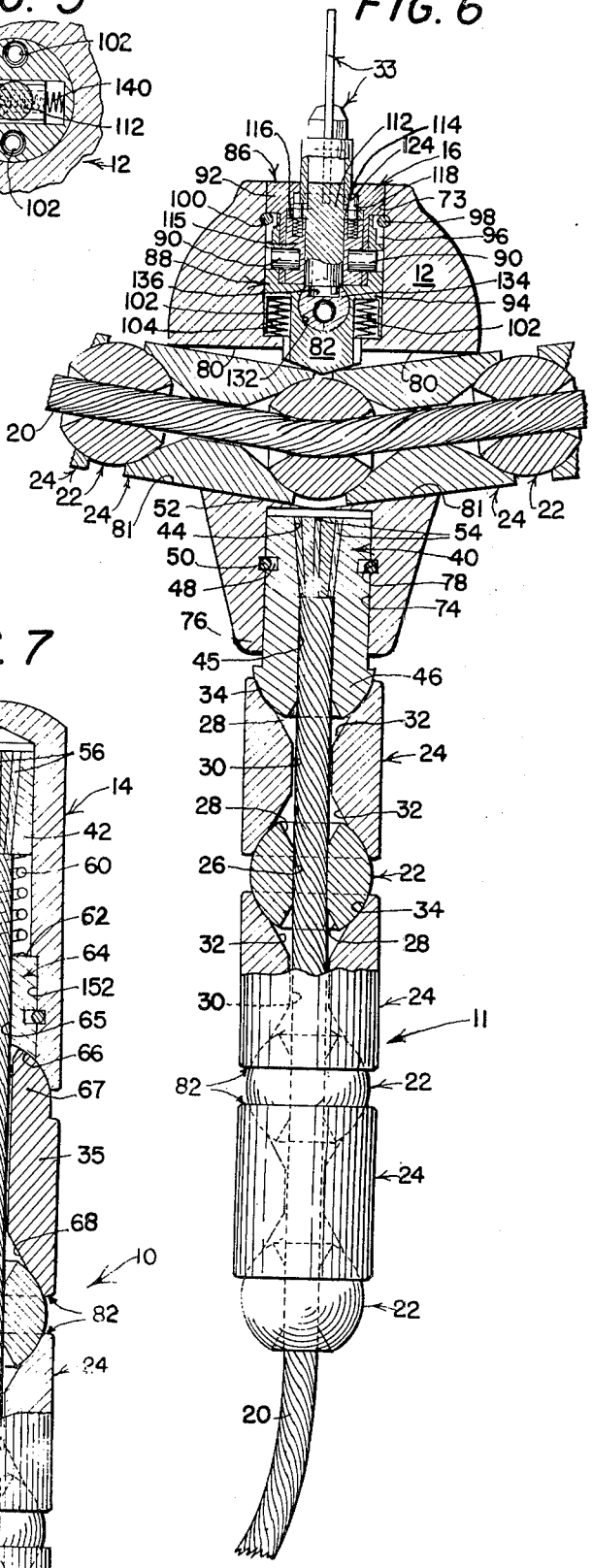
FIG. 6 is a longitudinal sectional view taken on the line 6—6 of FIG. 4.

Referring now to FIGS. 4 and 6 of the drawings, the retaining collar 40 is of cylindrical configuration and one end thereof has formed therein a frusto-conical axial bore 44 which merges with a cylindrical bore 45. The collar 40 is provided at its other end with a semi or frusto-spherical enlargement 46 which, in effect, constitutes a "half-ball." The latter is designed for cooperation with the adjacent semi-spherical socket 34 in the endmost socket member 24 on the stranded steel cable 20. The outer cylindrical surface of the collar 40 is provided with a medial external annular groove 48 which cooperates with a snap ring 50 in securing said collar permanently within the confines of the lock housing 12, the outer portion of the snap ring being adapted normally to fit in a hereinafter mentioned annular groove (see FIGS. 4 and 6) in the cylindrical socket in which the collar 40 fits. The collar 40 is applied to the adjacent or fixed end of the stranded cable 20 by initially inserting such end of the cable into the bores 44 and 45 until it becomes flush with the outer end face 52 of said collar 40, after which a plurality of tapered wedges 54 are driven endwise into the adjacent end of the cable 20 in order to spread the steel strands thereof outwardly and against the tapered wall of the bore 44 much in the manner that a wedge is driven into the distal end of the wooden hammer handle in order fixedly to maintain the same in the eye of the head of the hammer. By this expedient, any tension which may be applied to the cable 20 will enhance the wedging action of the wedges 54 and prevent withdrawal of the stranded steel cable from the bore 44 in the retaining collar 40 and, consequently, from the lock housing 12.

Figure 7:
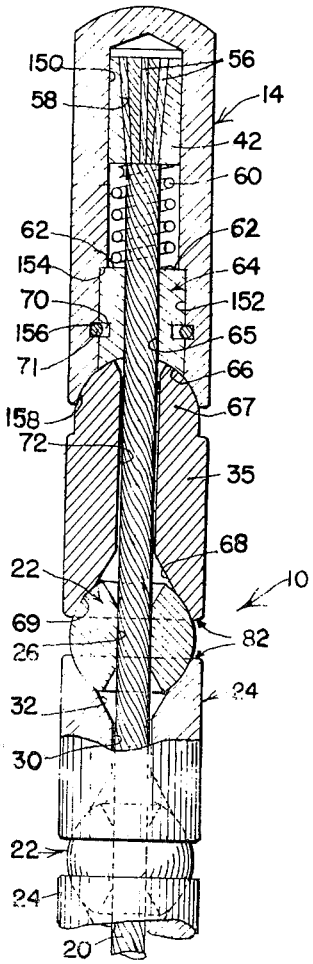
FIG. 7 is an enlarged sectional view, partly in elevation, taken substantially on the line 7—7 of FIG. 1.

Referring now to FIG. 7 of the drawings, it will be observed that the retaining collar 42 is similar to the collar 40 except for the fact that it is of smaller diameter and is devoid of an external groove therearound, as well as of the ball enlargement thereon. It is applied to the free or distal end of the stranded steel cable 20 in the same manner as the collar 40 is applied to the fixed end of the cable, i.e., by means of tapered wedges 56 which force the strands of the cable 20 against the wall of the frusto-conical axial bore 58 which is formed in and extends through the retaining collar 42. The collar 42 constitutes a reaction member for one end of a helical compression spring 60 which surrounds the free end of the cable 20, the other end of the spring bearing against the inner end face 62 of a cylindrical guide collar 64 having formed therein a longitudinal bore 65 through which the stranded steel cable 20 slidingly extends. The guide collar 64 is formed with a medial external annular groove 70 within which a snap ring 71 is seated, the groove and snap ring serving to lock the guide collar 64 within the terminal slack or lost-motion take-up device 14. The outer portion of the snap ring 71 is adapted normally to fit in the hereinafter described countersocket in the device 14 as shown in FIG. 7.

The outer end face of the guide collar 64 is formed with a semi-spherical recess 66 which bears against a semi-spherical half-ball 67, the latter being formed integrally on the outer end of the aforementioned ball and socket member 35. Such member 35 is provided with a frusto-conical recess 68 and a semi-spherical socket 69 which receives the adjacent ball member 22 on the stranded steel cable. The ball and socket member 35 is provided with a longitudinal bore 72 through which said stranded steel cable 20 extends.

During assembly of the armored cable 11, the retaining collar 42 is applied to the free end of the stranded steel cable 20 in such a manner that the compression spring 60 exists under compression so that the half-ball 67 is forced against the guide collar 64 with a moderate but yielding degree of pressure, thus transmitting pressure successively between the adjacent ball and socket members 22 and 24 throughout the entire length of the armored cable, the two retaining collars 40 and 42 constituting terminal reaction members which assimilate or contain such pressure. The thus assembled armored cable 11 of the assembly 10 constitutes an individual or unitary cable lock component which may be inventoried by the retailer in predetermined lengths for subsequent application thereto of the two end fittings, namely, the lock housing 12 and the slack or lost-motion take-up device 14.

Considering now the nature of the lock housing 12 of the armored cable-type lock assembly 10 and referring particularly to FIGS. 4 and 6 of the drawings, this housing is in the form of a pear-shaped body, the large end of which has formed therein a cylindrical lock-receiving socket 73 while the small end has formed therein a socket 74, the two sockets being coaxial with the lock housing 12. The socket 74 serves to receive the retaining collar 40. An internal annular groove 78 in the socket 74 registers with the external annular groove 48 in the collar 40 so that when the latter is inserted endwise in the socket 74, the snap ring 50 will fall in place between the two grooves and thus anchor the fixed end of the armored cable 11 to the lock housing 12 so that it is incapable of removal therefrom.

According to the present invention, the aforementioned transverse bore 31 in the lock housing 12, instead of being truly cylindrical as are the transverse bores in the lock housings of the armored cable-type lock assembly of my previously mentioned U.S. Pat. Nos. 3,696,647 and 3,765,196, is only generally cylindrical in that, while its upper portion 80 is semi-cylindrical, its lower portion is milled so that it slants downwardly and inwardly from its opposite outside rim regions as indicated at 81 (see FIG. 6). The diameter of the bore 31 at the opposite ends thereof is approximately equal to the external diameter of the various socket members 24 so that the armored cable may be passed through the bore 31, while the over-all diameter of the central region of the bore 31 is appreciably larger than that of the outer end regions thereof. This bore is designed for reception therethrough of a selected medial or distal end region of the armored cable 11 in order that a variable size loop may be established for vehicle-locking purposes. After pulling the armored cable through the bore 31 until the desired size loop is attained, the cylinder lock 16 is operated in such a manner as to lock the armored cable 10 to the lock housing, utilizing the key 33 for this purpose. This locking operation is effected under the control of a locking bolt 82 (see FIGS. 4 and 6) which has a tapered or conical outer or lower end 84 and is associated with the cylinder lock 16. When the locking bolt 82 is projected towards the small end of the housing 12 in connection with manipulation of the cylinder lock 16 into its locked position, it engages the rim regions of a pair of adjacent socket members 24 and forces the same downwardly as viewed in FIG. 6, thus "cocking" such socket members with respect to each other so that they assume out-of-alignment positions, and thereby automatically forcing the cylindrical side portions thereof hard against the slanting or V-shaped lower portions 81 of the bore 31, while at the same time forcing the upper surfaces of the socket members hard against the opposite open rims of the bore. In this position of the locking bolt 82, both adjacent socket members 24 in the bore 31 are securely wedged in position, so to speak, within the lock housing and the armored cable 10 is incapable of endwise sliding movement through the bore 37, thus relieving the locking bolt 82 from lateral strain in the event an attempt is made by an unauthorized person to open the lock assembly 10 by force.

Various forms of cylinder locks are capable of being installed within the lock housing 12, the only requirement being that such lock be provided with a locking bolt similar to the bolt 82 and capable of performing its intended function. The exemplary lock disclosed herein is of the "pop-up" axial tumbler type and involves in its general organization a composite lock cylinder embodying two telescopic cylinder parts in the form of a front or outer part 86 and a rear or inner part 88, the latter part being telescopically received within the former part and being permanently and fixedly secured thereto by means of transversely extending drive pins 90. Rim flanges 92 and 94 on the two parts 86 and 88 establish therebetween an annular recess 96 which receives therein a snap ring 98. The latter also seats within an internal groove 100 in the lock-receiving socket 72. The entire lock cylinder 16 is shiftable vertically between retracted and advanced positions wherein the snap ring 98 engages the rim flanges 92 and 94, respectively, the retracted position being shown in dotted lines in FIG. 4. Springs 102 in sockets 104 in the cylinder part 88 bear upwardly or outwardly against the cylinder lock and normally urge the latter to its projected position. The locking bolt 82 is integral with the rear cylinder part 88 and projects through the bottom wall of the socket 73 so that when such bolt is projected inwardly or downwardly as shown in FIGS. 4 and 6 of the drawings, it will press the adjacent ends of the adjacent socket members 24 within the bore 31 of the lock housing 12 downwardly as previously set forth so as to prevent withdrawal thereof from the bore 31. An additional component of the cylinder lock 16 includes a rotatable barrel part 112 having an outwardly extending annular flange 114 which, in combination with a fixed inner barrel part 115, establishes an interfacial plane 116 which normally is intersected by annular series of split tumblers 118. When all of the tumbler splits lie in the common interfacial plane 116, the outer barrel part 112 may be rotated, otherwise not.

Rotation of the outer barrel part 112 is accomplished by means of the key 33. The latter is tubular, has tumbler-engaging shoulders 124, and is adapted to be telescopically received over the barrel part 112 as is customary in connection with conventional axial tumbler-type locks.

In order releasably to latch the cylinder lock 16 in its retracted position within the socket 73, and thus, project the locking bolt 82 for armored cable-anchoring purposes, a latch bolt 130 (see FIGS. 4 and 5) is slidable in a bore 132 in the cylinder part 88. An eccentric pin 134 on the lower end of the barrel part 112 projects into a recess 136 in the latch bolt 130 so that rotational movement of the barrel part 112 is translated into sliding movement of the latch bolt. A compression spring 140 serves to urge the latch bolt to a projected position within a recess 144 (see FIG. 4) which is cut in the wall of the socket 73 in the lock housing 12, thus maintaining the cylinder lock 16 in its retracted position and maintaining the locking bolt 82 projected against the adjacent socket members 24 in the bore 31.

Referring now to FIG. 7, the end fitting or slack take-up device 14 is in the form of an elongated thimble-like construction and, in effect, constitutes a terminal armor or thimble section. The latter defines a relatively deep socket 150 and an enlarged countersocket 152 which define therebetween an annular shoulder 154. An annular groove 156 in the wall of the countersocket 152 cooperates with the aforementioned groove 70 in the guide collar 64 to receive the snap ring 71 so that when the guide collar is projected into the countersocket 152, the parts snap together and disconnection thereof is impossible. The open rim of the thimble section is formed with a semi-spherical recess 158 which, in effect, constitutes a continuation of the aforementioned ball-receiving recess 66 in the guide collar 64.

In the operation of the herein described armored cable-type lock assembly 10, assuming that the same is to be applied to a motorcycle such as the illustrated motorcycle 13, the elongated armored cable 11 is passed through appropriate openings in the motorcycle frame 21 and one of the wheels 25 and, thereafter, the terminal device 14 on the free or distal end of the cable is passed through the transverse bore 31 in the lock housing 12 and the latter is caused to slide on the armored cable to shrink the loop which has been established in encircling relationship with respect to the selected portions of the motorcycle 13. After the desired loop size has been approximately attained, care must be taken to insure that the adjacent ends of a pair of socket members 24, together with their contained ball member 22, is in alignment with the tapered locking bolt 82. This may readily be ascertained by causing the two socket members 24 to project equally from the opposite sides of the lock housing 12. It will be assumed that the cylinder lock 16 in the lock housing 12 has been left in its "popped-out" position from a previous unlocking of the same and, therefore, when such socket member and locking bolt alignment has been effected as set forth above, the cylinder lock may be pushed manually to its operative or locked position within the lock-receiving socket 73. As soon as this has been done, the latch bolt 130 (see FIG. 5) will snap into its projected position and enter the recess 144 in order to maintain the cylinder lock in such operative position. Such pushing of the lock cylinder will force the locking bolt 82 against the opposed edge regions of the two adjacent socket members 24 as previously described, thus forcing the same, together with the interposed ball member 22, downwardly and establishing an obtuse angular relationship between the adjacent socket members 24 as shown in FIG. 6 so that the armored cable 11 is no longer capable of being slid through the bore 31. Release of the armored cable 11 is accomplished by inserting the key 33 into the cylinder lock 16 and turning the same in such a manner as to withdraw the latch bolt 130 from the recess 144 in order to allow the cylinder lock 16 to snap to its popped-up position as shown in dotted lines in FIG. 4, whereupon the locking bolt 82 will be withdrawn from the transverse bore 31, thus freeing the armored cable 11 for sliding movement in the bore and complete removal therefrom. By reason of the fact that when the lock bolt 82 is in its operative position, the adjacent socket members are in what may be termed a "caked" condition due to the particular shape of the transverse bore 31 in the lock housing 12, unauthorized opening of the lock assembly 10 as a whole is effectively prevented without placing undue strain on the lock bolt. By reason of the fact that the special ball and socket member 35 which is interposed between the slack or lost-motion take-up device 14 and the endmost bolt member on the free or distal end of the stranded steel cable 20 embodies the integral half-ball 67, sharp tilting of the device 14 with respect to the special ball and socket member 35 will not expose the portion of the stranded steel cable 20 which is between the half-ball 67 and the semi-spherical recess 158 and, consequently, it is impossible to sever such portion of the stranded steel cable by way of a hacksaw or the like.

The invention is not to be limited to the exact arrangement of parts shown in the accompanying drawings or described in this specification as various changes in the details of construction may be resorted to without departing from the spirit of the invention. For example, although a particular form of cylinder lock 16 has been shown and described herein, other forms of cylinder locks may be employed if desired, the only criterion being that such locks be provided with a shiftable locking bolt which is similar to the bolt 82 and, in addition, is capable of similar cooperation with adjacent socket members 24 within the bore 31. Therefore, only insofar as the invention is particularly pointed out in the accompanying claims is the same to be limited.

Having thus described the invention what I claim as new and desire to secure by letters patent is:

1. An armored cable-type lock assembly comprising an elongated flexible stranded steel cable having a fixed end and a free end, a lock housing secured to said fixed end, an end member secured to said free end, a series of tubular sheathe-like armor sections threadedly received over said cable in bead-like fashion and forming with said stranded cable an armored cable assembly, said armored cable assembly including alternately arranged cylindrical tubular socket members and intervening ball members, each ball member, in combination with the adjacent tubular socket members, establishing a ball and socket joint between such adjacent socket members to allow limited flexing of the armored cable accompanied by corresponding angular displacement between adjacent socket members, said lock housing being provided with a transverse bore therein and adapted slidingly to receive therethrough axially aligned adjacent cylindrical socket members on the free end region of the cable in order to produce a closed variable size loop, one side wall portion of the bore being formed with a shallow internal concave relief area which is V-shaped from end to end, and releasable key-actuated locking means mounted in the lock housing and including a locking bolt disposed opposite to the relief area, extending at right angles to the bore, and slidable between a projected position wherein it extends into said bore and engages the opposed end edges of a pair of adjacent socket members in the vicinity of a ball and socket joint and displaces said adjacent socket members angularly and presses such joint into said relief area, said locking bolt being provided with a tapered end surface to the end that it makes linear contact with the adjacent end regions of the housing-enclosed socket members when it is fully projected and thus binds and kinks the armored cable within the bore and relief area, and a retracted position wherein the thus kinked region of the armored cable is relieved so that the armored cable may be withdrawn from the confines of the bore, thus releasing the cable and its associated armor sections for sliding movement through the bore.

2. An armored cable-type lock assembly as set forth in claim 1 and wherein the transverse bore defines opposite end openings which are approximately circular and of the same diameter as that of the socket members, one side of the wall portion of the bore is semi-cylindrical throughout, and the other side of the wall portion of the bore slopes inwardly from said circular end openings, thus establishing said V-shaped relief area.

3. An armored cable-type lock assembly as set forth in claim 2 and wherein said other side of the wall portion presents inwardly and sloping bottom portions which are semi-cylindrical in transverse cross section and have radii of curvature equal to the radius of the cylindrical socket members.

4. An armored cable-type lock assembly as set forth in claim 1 and wherein said lock housing is adapted in certain instances to extend substantially vertically and has a cylindrical socket formed in the lower end thereof, the wall of said socket being provided with an internal annular groove therearound, a cylindrical retaining collar is mounted on the fixed end of the cable and fits snugly in telescopic fashion within said socket, is provided with an external annular groove therearound in register with said internal annular groove, a snap ring seats within said grooves and serves permanently to retain the collar within the socket, the collar projects outwardly beyond the confines of the lock housing and is formed with an integral half-ball on its projecting end, and said half-ball cooperates with the adjacent socket member on the cable to establish a ball and socket joint in the immediate vicinity of the lock housing.

* * * * *